United States Patent [19]

Bunsick

[11] 4,170,233

[45] Oct. 9, 1979

[54] DEVICE FOR CORRECTING THE POSTURE OF A HUMAN FOOT

[76] Inventor: Gordon E. Bunsick, R.R. 3, Bath, Ontario, Canada, K0H 1G0

[21] Appl. No.: 887,053

[22] Filed: Mar. 16, 1978

[30] Foreign Application Priority Data

Feb. 7, 1978 [CA] Canada ..... 296377

[51] Int. Cl.[2] ..... A43B 7/14

[52] U.S. Cl. ..... 128/586

[58] Field of Search ..... 128/586, 594, 595, 596, 128/600, 601, 615, 621

[56] References Cited

U.S. PATENT DOCUMENTS

| | | | |
|---|---|---|---|
| 2,447,231 | 8/1948 | Bruckner | 128/586 |
| 2,510,654 | 6/1950 | Pepin | 128/596 |
| 2,631,387 | 3/1953 | Shaw | 128/586 |
| 2,680,919 | 6/1954 | Riggs | 128/596 |
| 2,862,313 | 12/1958 | Jones | 128/586 |

*Primary Examiner*—John D. Yasko

*Attorney, Agent, or Firm*—D. Paul Weaver

[57] ABSTRACT

The invention relates to a device for correcting the posture of a human foot. Unlike custom-made devices, which are made by a specialist to conform to the patient's foot, the device of the invention may be mass-produced and sold in standard sizes. The device is adapted for placement upon or within a foot-supporting insole structure and comprises an elongated substantially rectangular pad having a first area of substantially uniform thickness and a second area of a relatively greater thickness. A rearward end region of the pad is part of said first area of substantially uniform thickness and is adapted to support a medial inner one third of the calcaneous bone of the foot. A forward end region containing said second area of relatively greater thickness is adapted to support the surgical neck region of the first metatarsal bone of the foot. The thickness of said first area is such that the calcaneous bone is tilted at an angle of between 2½° and 8½° with respect to the major plane of the insole structure and the forward region of the foot containing the surgical neck regions of the metatarsal bones is tilted through an additional 1½° to 6½°. Preferably, the thickness of said first area is sufficient to tilt the calcaneous bone through an angle of 4½° and the thickness of said second area is sufficient to tilt the forward region of the foot through an additional 2½°.

5 Claims, 6 Drawing Figures

DEVICE FOR CORRECTING THE POSTURE OF A HUMAN FOOT

This invention relates to a device for correcting the posture of a human foot, particularly for the purpose of alleviating the discomforts associated with incorrect posture and of correcting the various ailments which result therefrom, such as fallen arches, arthritis of the hip, and the like.

The prior art has tended to attack this general problem in two ways. Firstly, various types of mass-produced footwear are commercially available which purport to offer superior comfort and support by utilizing built-up or padded insoles. Such footwear may come in the form of shoes, sandals, sneakers, and the like, or may be in the form of separate insoles for application to shoes. The vast majority of such footwear utilizes insoles which are built up in strategic areas to provide arch support and weight distribution. However, such devices do not correct the posture of the foot, but merely provide support for the foot in whatever posture it normally adopts - however incorrect that posture may be.

The foregoing devices may support the long (medial) arch of the foot by use of padding beneath the arch; they may provide support beneath the central second, third and fourth metatarsal bones; they may cup the outer perimeter of the heel by use of a horseshoe-shaped support or they may be formed to mold themselves to the contours of the foot with the object of diverting pressure from weight-bearing points. Various patents are based upon one or more of the foregoing approaches. For example, U.S. Pat. No. 879,527 (Dorrity), issued Feb. 18, 1908, teaches an elliptical shaped pad (with supplementary pads to add to the original pad as it wears down) adapted to be placed under the long arch of the foot. U.S. Pat. No. 2,074,286 (Sullivan), issued Mar. 16, 1937, teaches an accommodative air pocket device to disperse weight from weight-bearing focal points and support the long arch and U.S. Pat. No. 2,084,517 (Vogel) teaches a pneumatic gas chamber device for the same purpose. U.S. Pat. No. 2,177,166 (Persichino) teaches another pneumatic supporter of the long arch and central metatarsal areas, which is also intended to relieve pressure from the heel area. U.S. Pat. No. 2,645,865 (Town) teaches another cushioning weight dispersing insole, providing cushioning under the long medial arch and central metatarsal arch. Another Town Patent—U.S. Pat. No. 2,762,134—teaches an alternative type of cushioning insole accommodating weight pressure dispersion in the arch and central metatarsal areas and also in the heel. U.S. Pat. No. 2,917,844 (Scholl) teaches another arch supporter, accommodative in nature and having an aperture in the heel region for cupping the heel to disperse weight in that region and a lift which can be used under the long arch or central metatarsal arch. U.S. Pat. No. 3,292,227 (Teschon) is directed to improving shoe fit and incorporates the long arch supporting principle described above, and U.S. Pat. No. 3,990,457 (Voorhees) is a cushioning accommodative insole having compartments containing liquid media to disperse weight.

All of the foregoing devices are totally unscientific and arbitrarily lift up the long arch using elliptical or egg shaped inserts, oval or tear shaped inserts for the central second, third and fourth metatarsal area and horseshoe-shaped heel weight dispersing inserts, some of which contain apertures for receiving the center of the heel.

The second and scientifically superior approach is to provide custom-made inserts for footwear, which are designed to correct foot posture by tilting the foot through a certain angle in order to align the bones correctly with one another and with the tibia of the leg. It is an established medical fact that misalignment of these bones is a major cause of many ailments, such as arthritis, fallen arches, bunions, etc., as well as various aches and pains associated with the legs and feet. As it will be appreciated, the human foot is a complex structure having a variety of joints and bones, all of which move interdependently. By tilting the foot to its correct orientation, it is found that these various bones and joints tend to assume their correct relative positions, whereat pressure points and muscle tensions are relieved and the arch assumes its normal configuration. Such devices are produced by forming a cast of the patient's foot, determining the necessary angle of tilt for the foot to correct its orientation and casting a device from a resin or the like which hardens to provide a rigid structure conforming to the underside of the patient's foot and giving the required angle of tilt. Of course, such devices are only available on a custom-made basis and are expensive in that they require the skill and services of a podiatrist.

My invention is based upon the realization that the necessary tilting of the foot need not be at a critical angle to have significant therapeutic value but that the tilt angle or angles may be optimized to provide significant benefit to a broad cross-section of people. Furthermore, I have realized that by providing tilt at specific locations of the foot, the necessity for custom-made devices, which extend under and conform to the entire lower surface of the foot from the heads of the metatarsal bones to the rear of the foot, is avoided. More particularly, I have found that by placing support under the medial third of the calcaneous bone to tilt the rear part of the foot through an angle of from $2\frac{1}{2}°$ to $8\frac{1}{2}°$ and by supporting the surgical neck region of the first metatarsal bone to provide an additional $1\frac{1}{2}°$ to $6\frac{1}{2}°$ tilt to the forward part of the foot, no other special support is required. In particular, no support beneath the arch is required, because the corrected orientation of the front and rear portions of the foot, (between which the arch extends), operates to hold the arch in its correct configuration for normal function—somewhat analogously to the arch of a bridge, which is held in position by its end supports. Thus, the arch is not braced or supported from beneath, as in the case of conventional devices, but the ends of the arch—which are the first metatarsal and the calcaneous bone—are correctly positioned to hold the arch in its proper orientation for normal function. It should be appreciated that my novel device does not change the structure of the foot in any way, although it can assist the foot to re-orient itself over a period of time. Essentially, the device is merely corrective of the position of the foot to permit normal functioning thereof—rather like a pair of eyeglasses will allow normal functioning of the eyes, even though they do not change the eyes themselves.

The foregoing has enabled me to develop an extremely simple but effective device which can be made in a variety of standard sizes to fit different sizes of feet but which does not require to be custom-made.

Accordingly, my invention comprises a device for correcting the posture of a human foot, such device being adapted for placement upon or within a foot-supporting insole structure such as a removable insole for a shoe or any other type of footwear or to be made an integral part of an item of footwear. Thus, it will be appreciated that the term "foot-supporting insole structure" as employed herein covers both fixed and removable insoles and also is intended to cover the hard foot-supporting platform of a clog or similar type of footgear. The device comprises an elongated substantially rectangular pad having a first area of substantially uniform thickness and a second area of relatively greater thickness. The rearward end of the pad, which accommodates the medial third of the calcaneous bone, contains the first area of substantially uniform thickness and is sufficiently thick to tilt the rear part of the foot through an angle of from 2½° to 8½°. The forward end of the pad contains the second area of relatively greater thickness and is spaced from the rearward end of the pad by such distance that with the medial third of the calcaneous bone resting upon the pad adjacent its rearward end, the first metatarsal bone will be located with its surgical neck region resting upon the relatively thicker part of the pad. By providing a thicker area of the pad at its forward end, the forepart of the foot is tilted through an additional 1½° to 6½°. In order to accommodate the device upon a conventional insole or in a conventional shoe or the like, the medial or inner corner of the pad may be rounded at its rearward end region to fit the outline thereof. As stated above, the device may be made in a variety of standard sizes of feet, and the spacing between the rearward end of the pad and the thicker portion of the pad adjacent its forward end will be selected in accordance with the foot size which the device is intended to fit. Also, supplementary pads may be added at desired locations to customize the device for individual requirements.

The invention will now be described further by way of example only and with reference to the accompanying drawings wherein.

Figure 1:
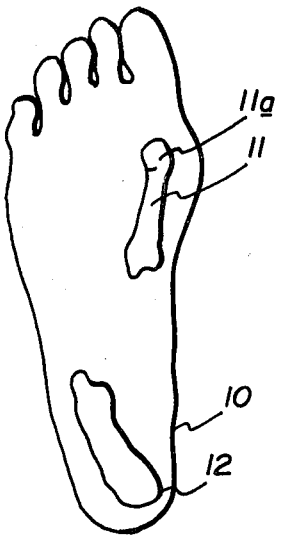
FIG. 1 is a plan view of a foot showing the locations of the first metatarsal bone and the calcaneous (heel) bone.

Referring now to the drawings, and particularly to FIG. 1, a foot 10 has a first metatarsal bone 11 extending rearwardly of the big toe and a calcaneous bone 12. Naturally, many other bones are present within the foot, but these are omitted for the sake of clarity. Generally speaking, the long or medial arch region of the foot extends between the regions of the bones 11 and 12.

Figure 2:
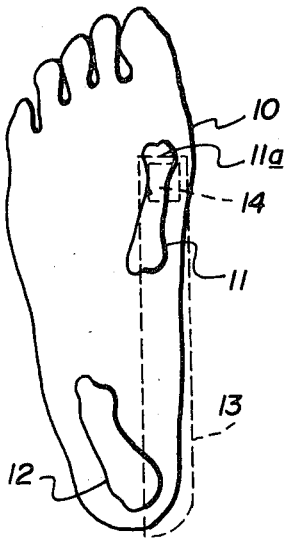
FIG. 2 is similar to FIG. 1 but shows the device of the present invention superimposed thereon in dotted lines.

In FIG. 2, the device of the invention is superimposed in dotted lines upon the outline of the foot. The device includes a base pad 13 (shown in broken lines) which extends from its proximal position at the very end of the plantar surface of the rear of the calcaneous bone 12, distally to include the anatomical surgical neck area of the first metatarsal bone 11 immediately behind the head 11*a*. A smaller pad 14 (also shown in broken lines) is superimposed on the region of the base pad 13 immediately beneath the anatomical surgical neck area of the first metatarsal bone 11 and thus provides the supporting surface for this area. Preferably, the pad 13 has an adhesive backing 13*a* on its lower surface, for a purpose hereinafter described.

Figure 3:
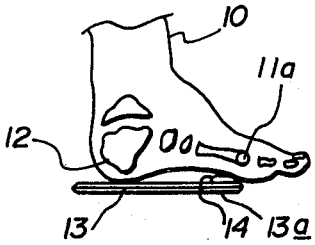
FIG. 3 is a side view of a foot resting upon the device of the present invention.
Figure 4:
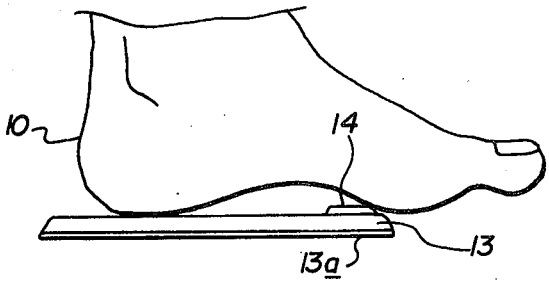
FIG. 4 is a side elevation of a detail of FIG. 3.
Figure 5:
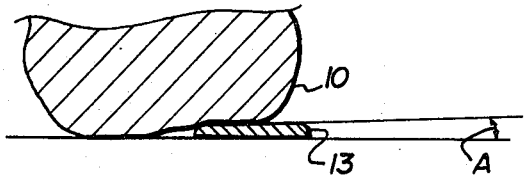
FIG. 5 is a cross-sectional view through the rear part of the foot and the device, showing the angle of tilt at this location.
Figure 6:
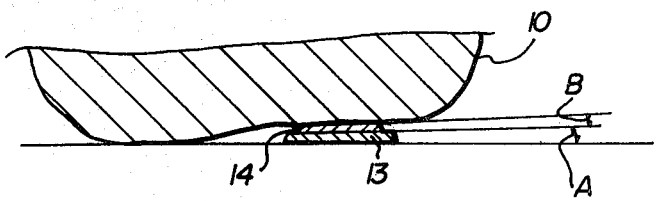
FIG. 6 is a view similar to FIG. 5 but taken through the forward part of the foot in the region of the first metatarsal bone.

FIGS. 3 and 4 show in side elevation the base pad 13 and the extra pad 14 in their operative positions beneath a foot. FIG. 3 shows the pad 13 located beneath the medial third of the calcaneous bone. The angle A, which is the angle of tilt relative to the bottom surface of the foot, is between 2½° and 8½° and I have found that 4½° is a good compromise for the majority of feet. FIG. 6 shows the lower and upper pads 13 and 14 in position beneath the first metatarsal bone. It will be realized that the pad 14 is just wide enough to support the first metatarsal bone without interfering with the second or subsequent bones. It was previously assumed that support should be provided across the entire width of the foot, thus encompassing all five metatarsals. However, I have found that such support is not necessary and that the required tilt can be achieved quite effectively by merely lifting the first metatarsal in the anatomical surgical neck area. The angle of tilt of the forefoot relative to the rear part of the foot is between 1½° and 6½°, and preferably 2½° for the average foot (angle B in FIG. 6). Hence the total angle of correction of the forefcot is angle A plus angle B.

Thus, the initial tilt angle A is applied under the medial one-third of the calcaneous bone and extends the entire length of the device from its rear part beneath the end of the calcaneous bone forwardly to its front part beneath the surgical neck area of the first metatarsal bone. This establishes a basic corrective angle of tilt for the foot. Additionally, the pad 14 provides an extra tilt to the forefoot to support the forefoot at a corrected angle of between 1½° and 6½° (preferably 2½°) relative to the rear part of the foot.

The precise materials from which the device is constructed are not critical, provided that in their compressed states, they provide sufficient support to maintain the required angles of tilt. Therefore, suitable materials may be sponge rubber, felt padding, or the like.

One corner of the device at its rearward medial inner end is rounded off as shown in FIG. 2 in order to conform to the shape of a conventional insole or footgear. Also, the edges of the device are preferably tapered, as shown in the drawings, to provide a better finish and to avoid irritating edges which would cause discomfort to the user.

In its practical application, the device may be incorporated in a shoe or any type of footgear during its manufacture or in a removable insole for insertion in a footgear. Thus, the device may be added to the insole before the final layer of material is applied, so that the device is inside the insole and the foot-supporting surface becomes contoured to the required shape without the device being visible to the eye. Clearly, this arrangement has aesthetic advantages over that wherein the device is simply applied to an insole surface. In any case it is useful for the base of the device to be provided with an adhesive backing for attachment to the interior or the surface of the insole, since it is important that the device be securely and critically located to ensure that the desired regions of the foot are properly corrected. Alternatively, the device may be cemented or otherwise secured in position.

Whilst the invention has been exemplified by reference to a multi-layered device, the necessary thicknesses at the end regions of the device may be obtained in a single pad or block of material by well known techniques chosen according to the precise material used.

The embodiments of the invention in which an exclusive property or privilege is claimed are defined as follows:

1. A device for correcting the posture of a human foot, said device adapted for placement upon or within a foot-supporting insole structure and comprising an elongated substantially rectangular pad having a first area of substantially uniform thickness and a second area of a relatively greater thickness, a rearward end region of said pad being part of said first area of substantially uniform thickness and adapted to support a medial inner one third of the calcaneous bone of said foot and a forward end region containing said second area of relatively greater thickness adapted to support the surgical neck region of the first metatarsal bone of said foot, the thickness of said first area being such that said calcaneous bone is tilted at an angle of between $2\frac{1}{2}°$ and $8\frac{1}{2}°$ with respect to the major plane of said insole structure and the forward region of said foot containing the surgical neck regions of the metatarsal bones is tilted through an additional $1\frac{1}{2}°$ to $6\frac{1}{2}°$.

2. The device of claim 1, wherein the thickness of said first area is sufficient to tilt said calcaneous bone through an angle of $4\frac{1}{2}°$ and the thickness of said second area is sufficient to tilt the forward region of said foot through an additional $2\frac{1}{2}°$.

3. The device of claim 1 or claim 2, wherein said pad comprises an elongated first layer of material extending over the area of said pad and defining the outline thereof, said first layer providing said first area of substantially uniform thickness, and a second layer located upon an area of said first layer adjacent said forward end region of said pad and providing said second area of relatively greater thickness.

4. The device of claim 1 or claim 2, wherein said pad is provided with an adhesive backing for attachment to said foot-supporting insole structure.

5. The device of claim 1 or claim 2, wherein a medial corner of said pad at its rearward end is rounded to fit a rounded outline of said foot-supporting insole structure.

* * * * *